US006082984A

United States Patent [19]

Matsumoto et al.

[11] Patent Number: 6,082,984

[45] Date of Patent: Jul. 4, 2000

[54] FLUID PUMP HAVING PRESSURE PULSATION REDUCING PASSAGE

[75] Inventors: Tatsuya Matsumoto, Kariya; Motoya Ito, Hekinan; Fumihiro Nimura, Kariya, all of Japan

[73] Assignee: Denso Corporation, Kariya, Japan

[21] Appl. No.: 09/236,383

[22] Filed: Jan. 25, 1999

[30] Foreign Application Priority Data

Mar. 18, 1998 [JP] Japan ..... 10-068031
Nov. 10, 1998 [JP] Japan ..... 10-319399

[51] Int. Cl.[7] ..... F01C 1/10

[52] U.S. Cl. ..... 418/171; 418/181; 418/166; 418/15; 417/312; 417/410.4; 415/55.1

[58] Field of Search ..... 418/181, 171, 418/166, 15; 417/312, 410.4; 415/55.1

[56] References Cited

U.S. PATENT DOCUMENTS 5,263,818 11/1993 Ito et al. ..... 418/15
5,340,293 8/1994 Yasuda ..... 418/171
5,586,858 12/1996 Tuckey ..... 415/55.1
5,997,262 12/1999 Finkbeiner et al. ..... 417/410.4

FOREIGN PATENT DOCUMENTS

U-63-143780 of 0000 Japan .
404148090A 5/1992 Japan ..... 418/171
404159475A 5/1992 Japan ..... 418/171

*Primary Examiner*—Thomas Denion
*Assistant Examiner*—Thai-Ba Trieu
*Attorney, Agent, or Firm*—Nixon & Vanderhye P.C.

[57] ABSTRACT

A fuel pump comprises a pump unit and a motor unit. The pump unit is a trochoid gear type having rotors in a pump chamber defined by a pair of side plates and a cylindrical housing. A disk plate is attached to the side plate to provide an arcuate-shaped pressure pulsation reducing passage jointly with the side plate. Protrusions or recesses are provided in the passage to cause turbulence in fuel flowing through the passage. This turbulence scatters pressure pulsation in the fuel thereby to reduce the pressure pulsation.

10 Claims, 6 Drawing Sheets

FLUID PUMP HAVING PRESSURE PULSATION REDUCING PASSAGE

CROSS REFERENCE TO RELATED APPLICATION

This application relates to and incorporates herein by reference Japanese Patent Applications No. 10-68031 and 10-319399 filed Mar. 18, 1998 and Nov. 10, 1998, respectively.

BACKGROUND OF THE INVENTION

1. Field of the Invention

The present invention relates to a fluid pump, which has a pressure pulsation reducing function.

2. Related Art

There are two types of fluid pumps such as a fuel pump for a vehicle, one being a positive displacement type such as a trochoid gear pump and a roller pump and the other being a non-displacement type such as a turbine (Wetsco) pump.

In the displacement type pump, fluid is sucked and discharged by variations in the displacement of a pump chamber. It has therefore a higher pumping efficiency, while causing a large pressure pulsation in the discharged fluid, large noise and large vibration. In the non-displacement type pump, on the other hand, fluid is sucked and discharged by rotation of a turbine (impeller) within a pump casing. As the displacement of a pump chamber is not varied, it causes less pressure pulsation in the discharged fuel, less noise and less vibration.

In the case that the displacement type pump is used, a damper device is provided at a fluid discharge side or a fluid pipe is formed by an elastic material to reduce the pressure pulsation, noise and vibration. Particularly, in the case that the displacement type pump is used as a fuel pump for a vehicle, a sound-shielding material is attached to a vehicle chassis to shield noise. Those will result in rise in the production cost.

SUMMARY OF THE INVENTION

It is therefore an object of the present invention to provide a fluid pump, which provides a high pumping efficiency while reducing noise, vibration and production cost.

According to the present invention, a fluid pump has a pressure pulsation reducing passage at its fluid discharge side. Protrusions or grooves are formed in the pulsation reducing passage to cause fluid to swirl when the fluid hits the protrusions or walls of the grooves. Thus, turbulence is generated in the fluid flow, which scatters the pressure pulsation in the discharged fluid so that the pressure pulsation, noise and vibration are reduced.

Preferably, the pulsation reducing passage is formed long. It may be formed into an arcuate shape or into a turned shape along a side wall of a pump unit. Further, the pulsation reducing passage may be formed on a metal or resin disk plate, which is interposed between the pump unit and a motor unit.

BRIEF DESCRIPTION OF THE DRAWINGS

Other objects, features and advantages of the present invention will become clearer from the following detailed description made with reference to the accompanying drawings. In the drawings.

DETAILED DESCRIPTION OF THE PREFERRED EMBODIMENT

Figure 1:
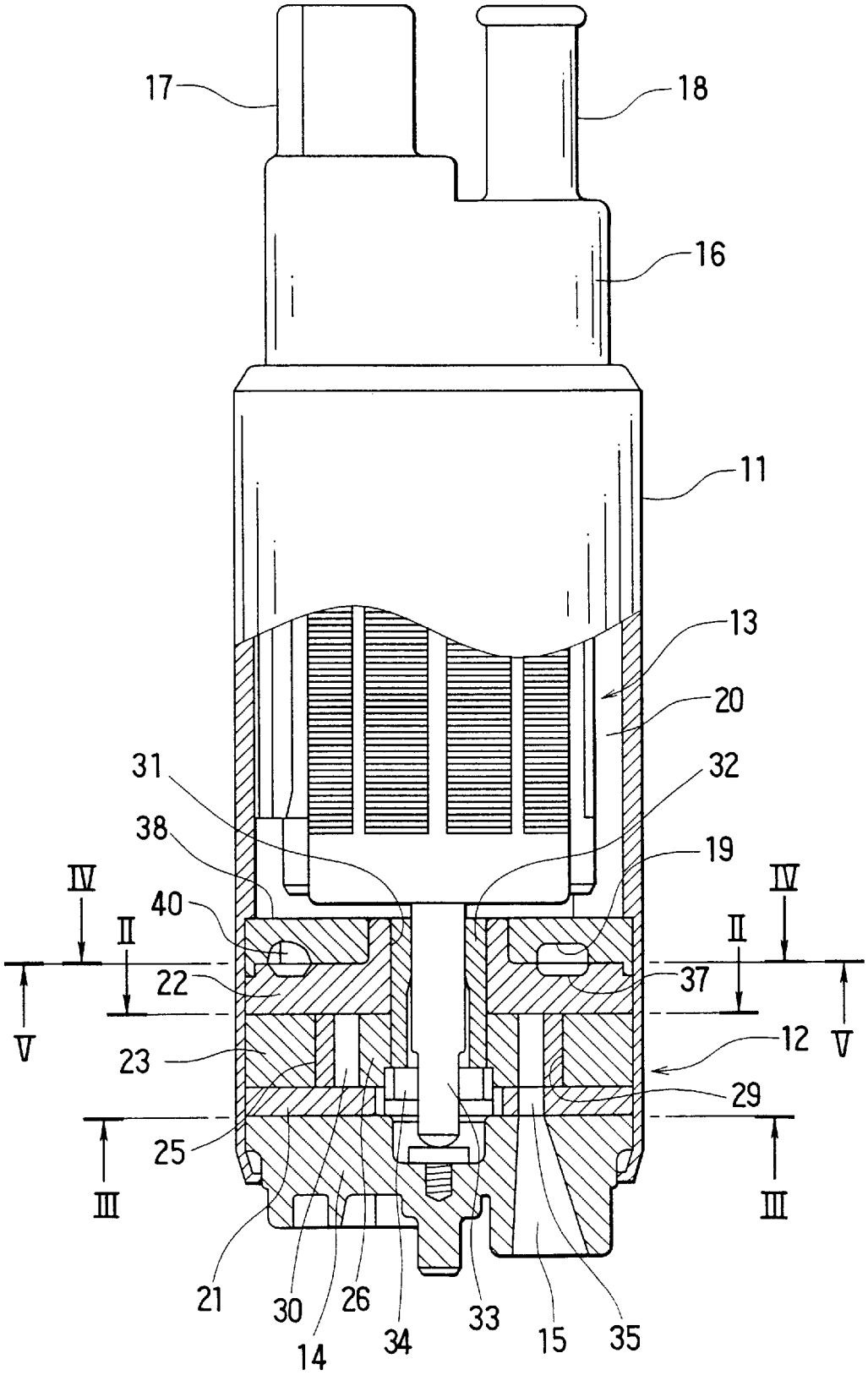
FIG. 1 is a front view showing, partly in section, a fuel pump according to a first embodiment of the present invention.

The present invention will be described in further detail with reference to various embodiments, which are directed to a fuel pump for a vehicle as a fluid pump. The same or like component parts of the fuel pump are designated by the same or like reference numerals.

(First Embodiment)

Referring first to FIG. 1, a fuel pump comprises a trochoid gear type pump unit 12 and an electric motor unit 13, which are assembled within a cylindrical housing 11. One end (bottom) of the housing 11 is crimped onto a pump cover 14, which covers the pump unit 12, to tightly fix the cover 14 and the pump unit 12 in position. The pump cover 14 is formed with a fuel suction inlet 15, through which fuel in a vehicle fuel tank (not shown) is sucked into the pump unit 12. The other end (top) of the housing 11 is crimped onto the motor unit 13 to fix the motor unit 13 in position. An electrical connector 17 and a fuel discharge outlet 18 are provided on the motor cover 16. The connector 17 is for supplying electric power to the motor unit 13. The fuel discharge outlet 18 is in communication with a pressure pulsation reducing passage 19, 37 through a fuel passage 20 provided in the motor unit 13. The pressure pulsation reducing passage 19, 37 is provided between the pump unit 12 and the motor unit 13. Thus, the fuel discharge outlet 18 discharges fuel pumped out from the pump unit 12 to an external device (not shown) such as a fuel injection device for a vehicle engine.

Figure 2:
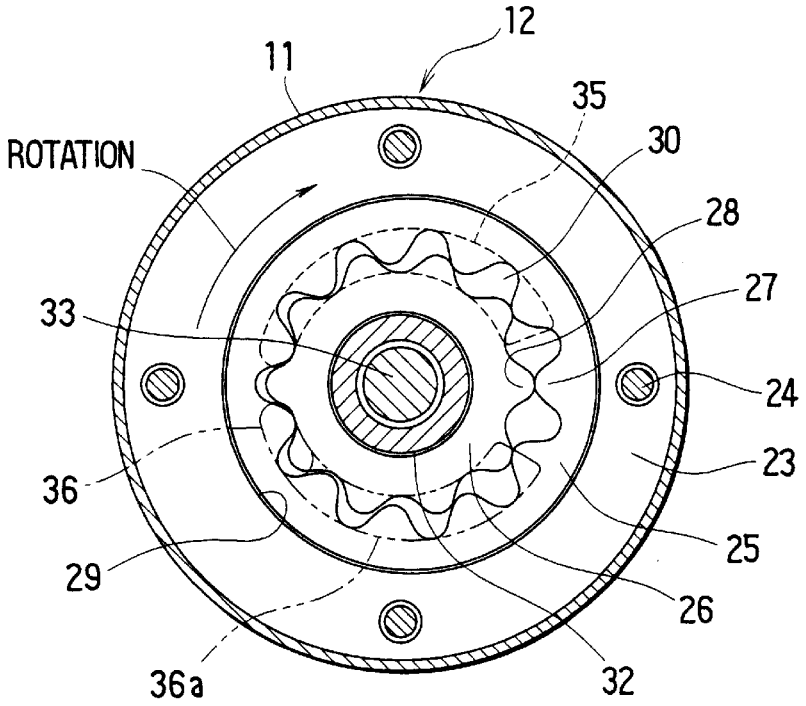
FIG. 2 is a sectional view showing the fuel pump taken along a line II—II in FIG. 1.

As shown in FIG. 2, the pump unit 12 comprises a pair of disk-shaped side plates 21, 22 and a cylindrical housing 23 sandwiched between the side plates 21, 22 fluid-tightly. Those are tightened by a plurality of screw threads (not shown) to form a pump casing. An outer rotor 25 and an inner rotor 26 are accommodated within the pump casing. Trochoid teeth 27 are formed equi-angularly on the inner circumference of the outer rotor 25, and trochoid teeth 28 are formed equi-angularly on the outer circumference of the inner rotor 26. The number of trochoid teeth 28 of the inner rotor 26 is less by one than that of the trochoid teeth 27 of the outer rotor 25. The outer rotor 25 is fitted rotatably in a circular hole 29, which is formed in the cylindrical housing 23 eccentrically from the radial center of the housing 23. The inner rotor 26 is accommodated inside of the outer rotor 25 in an eccetric or decentered manner, so that a number of pump chambers 30 are formed by meshing or contacting between the trochoid teeth 27, 28. As the outer rotor 25 and the inner rotor 26 are placed decentered from each other, the rate of meshing between the trochoid teeth 27, 28 increases and decreases gradually, so that the displacement (volume) of each pump chamber 30 increases and decreases gradually in each cycle of rotor rotation.

Figure 3:
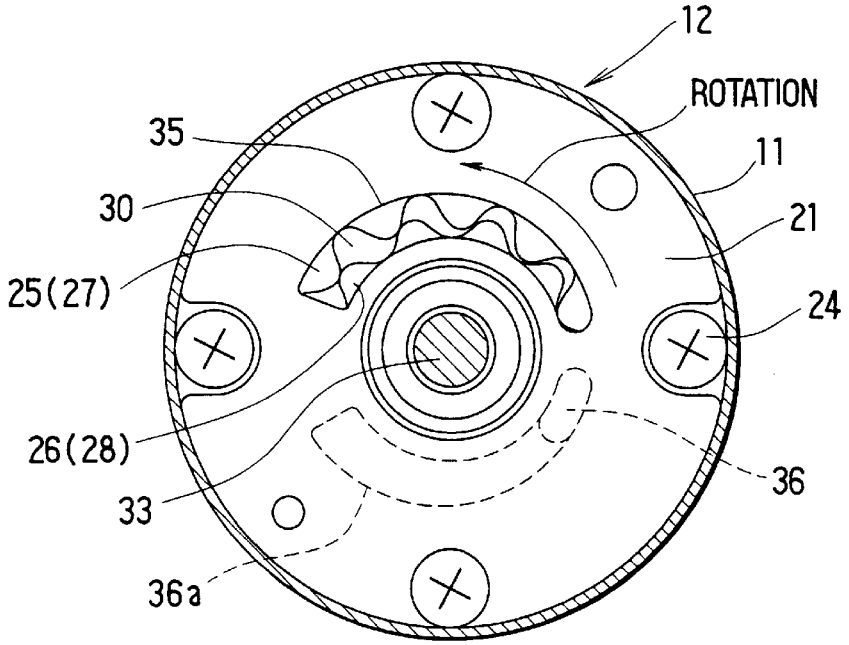
FIG. 3 is a sectional view showing the fuel pump taken along a line III—III in FIG. 1.

As shown in FIGS. 1 and 3, a suction port 35 is formed on the side plate 21 to suck in the fuel into the pump chambers 30 therethrough. The suction port 35 is formed into an arcuate or crescent shape, so that it communicates with the pump chambers 30 at a position where the chamber displacement increases as the rotors 25, 26 rotate.

Figure 4:
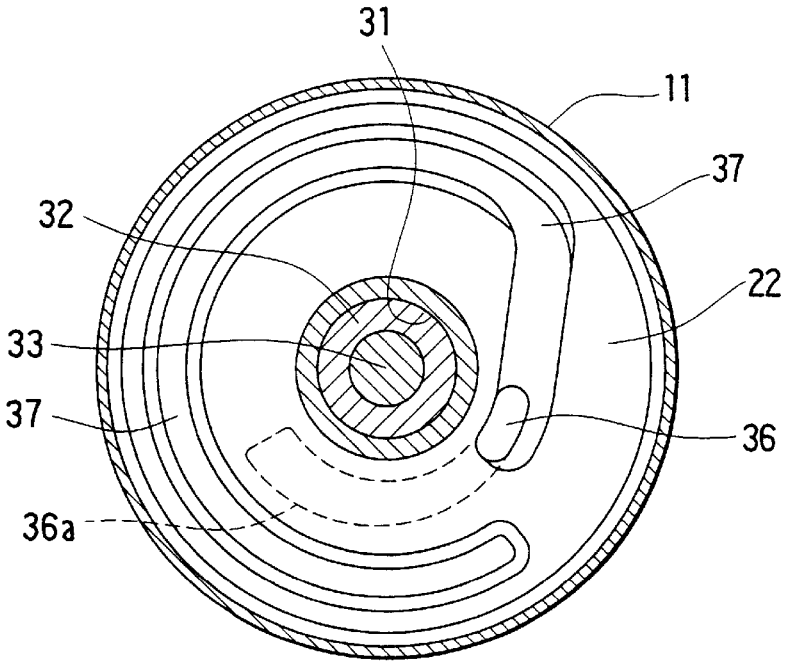
FIG. 4 is a sectional view showing the fuel pump taken along a line IV—IV in FIG. 1.

As shown in FIG. 4, a discharge port 36 is formed on the side plate 22. A groove 36*a* is formed on the lower or inside surface (rotor side) of the side plate 22 to guide the fuel to the discharge port 36. This groove 36*a* is formed into an arcuate or crescent shape, so that it communicates with the pump chambers 30 at a position where the chamber displacement decreases as the rotors 25, 26 rotate. The passage 37 is formed into an arcuate shape on the upper or outside surface of the side plate 22 to guide the fuel discharged from the discharge port 36 in the circumferential direction.

Figure 5:
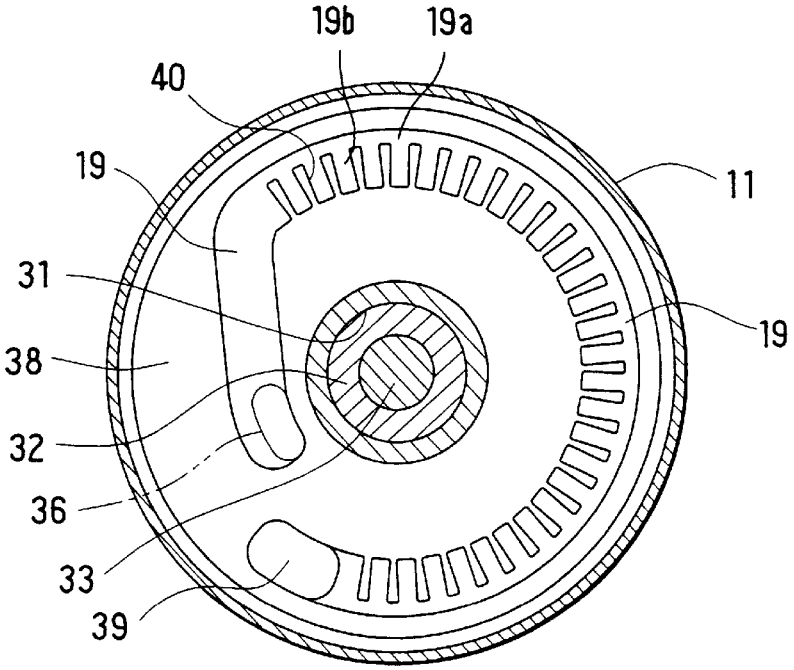
FIG. 5 is a sectional view showing the fuel pump taken along a line V—V in FIG. 1.

Referring to FIG. 1 again, a metal or resin disk plate 38 is provided in a space between the motor unit 13 and the side plate 22. The disk plate 38 is attached fluid-tightly to the side plate 22. As shown in FIG. 5, the passage 19 is formed arcuately on the lower or inside surface of the disk plate 38 to guide the fuel discharged form the discharge port 36 in the circumferential direction. At the terminal end of the passage 19, a discharge port 39 is formed to discharge the fuel to the motor unit side, that is to the fuel passage 20 in the motor unit 13. Thus, the passages 19, 37 jointly provide the pressure pulsation reducing passage. In the passage 19 of the disk plate 38, a plurality of fin-shaped protrusions 40 is formed at a uniform angular interval. Each protrusion 40 extends in the radial direction and generally perpendicularly to the flow direction of fuel, thereby narrowing the cross sectional area of the passages 19, 37. That is, the passage 19 is divided into an arcuate passage 19*a* and recesses 19*b*, each of which extends radially inwardly from the arcuate passage 19*a*.

A cylindrical bearing 32 is fitted in a through hole 31 formed in the radial center of the side plate 22. A rotary shaft 33 of the motor unit 13 is supported rotatably in the inside of the bearing 31, and the inner rotor 26 is fitted rotatably on the outside of the bearing 32. A coupling 34 is fixed to the longitudinal end of the rotary shaft 33, and is engaged with the inner rotor 26. Thus, when the rotary shaft 33 of the motor unit 13 rotates, the inner rotor 26 also rotates integrally with the rotary shaft 33. As the outer rotor 25 is in meshing engagement with the inner rotor 26, it also rotates with the inner rotor 26.

During each rotation of the rotors 25, 26, the rate of meshing between the rotors 25, 26 gradually increases and decreases, thereby causing a gradual increase and decrease in the displacement of each pump chamber 30. In the pump chambers 30 having increasing displacement sucks the fuel from the suction port 35 and pressurizes the sucked fuel, while transferring the pressurized fuel toward the discharge port 36. on the other hand, the pump chambers 30 having decreasing displacement discharge the transferred fuel from the discharge port 36 to the passages 19, 37 through the groove 36*a*.

The fuel discharged from the discharge port 36 flows through the passages 19, 37, while colliding with each protrusion 40 and swirling. As a result, turbulence occurs at the upstream side and the downstream side of the protrusion 40. Although the pressure of fuel discharged from the trochoid gear type fuel pump fluctuates comparatively greatly, this pressure pulsation is scattered by the turbulence generated at the upstream and downstream of each protrusion 40, thus removing the pressure pulsation in the fuel discharged from the fuel discharge outlet 18. As a result, noise and vibration caused by the pump unit 12 is reduced, while maintaining a high pumping efficiency by the use of the trochoid gear type for the pump unit 12.

As the passages 19, 37 having the protrusions 40 are provided by additionally using the disk plate 38, the pressure pulsation reduction can be attained in a simple construction, in a simple assembling work and in low cost. As the disk plate 38 is disposed between the pump unit 12 and the motor unit 13, the vacant space between the pump unit 12 and the motor unit 13 can be used effectively without enlarging the size of the fuel pump. Further, as the passages 19, 37 are formed between the pump unit 12 and the motor unit 13, vibration caused by the pressure pulsation at the downstream of the passages 19, 37, i.e., at the motor unit side, can be suppressed.

It is to be noted that the passages 19, 37 may be formed into a straight shape along the side wall of the pump unit 12. However, it is preferred to form the passages 19, 37 into the arcuate shape so that the passages 19, 37 can have a sufficient length to reduce the pressure pulsation as much as possible. The protrusions 40 may be formed in the passage 37 on the side plate 22. The protrusion 40 may have a different shape. Further, the pressure pulsation reducing passage may be provided only by the passage 19 of the disk plate 38, so that the side plate 22 has no passage for pressure pulsation reduction.

(Second Embodiment)

Figure 6:
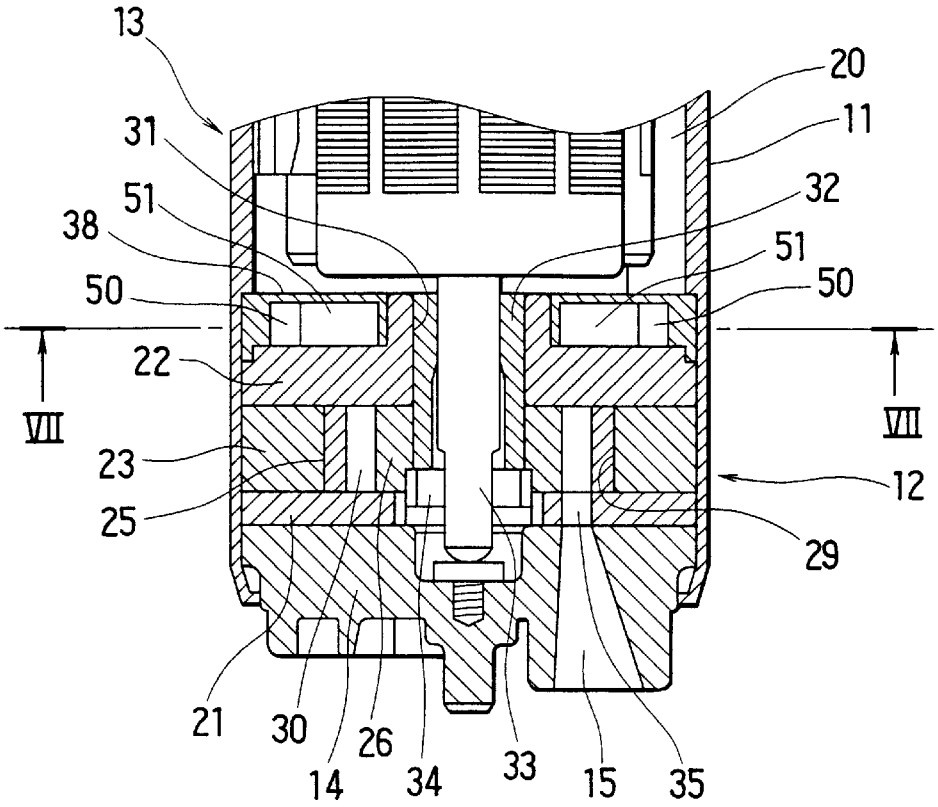
FIG. 6 is a partial front view showing a fuel pump, in section, according to a second embodiment of the present invention.
Figure 7:
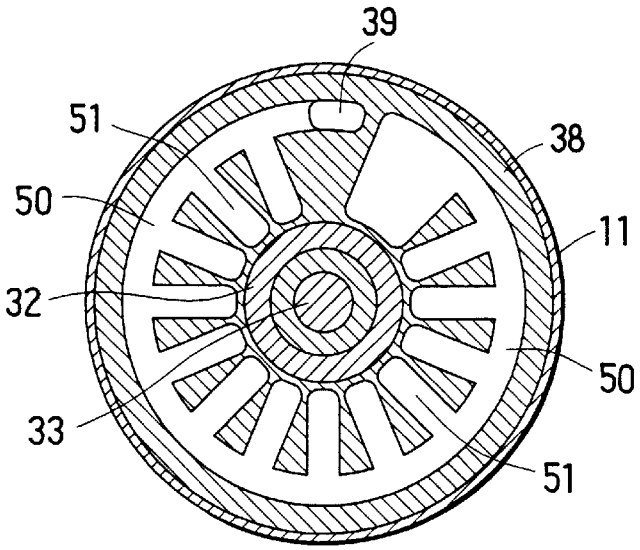
FIG. 7 is a sectional view showing the fuel pump taken along a line VII—VII in FIG. 6.

In this embodiment, as shown in FIGS. 6 and 7, a passage 50 is formed into an arcuate shape along the outer circumference of the disk plate 38, and a plurality of elongated recesses 51 is formed equi-angularly to communicate with the passage 50. Each elongated recess 51 extends radially inwardly from the passage 50 closely to the bearing 32. The side wall of the side plate 22 facing the disk plate 38 may be planar or may be formed to have a passage and elongated recesses in communication with the corresponding passage 50 and recesses 51.

According to this embodiment, the fuel flowing through the passage 50 flows also into the recesses 51 and swirls while colliding with the inner walls of the recesses 51. Thus, turbulence is generated at the connection point between the passage 50 and the recesses 51. Due to this turbulence, the pressure pulsation is scattered and reduced.

It is ascertained that the pressure pulsation is reduced more:

(1) as the number of elongated recesses increases;

(2) as the flow throttling ratio (ratio between the maximum flow area and the minimum flow area in the passage) increases;

(3) as the opening area of the recess 51 (angular interval of the adjacent recesses 51) increases; and (4) as the throttling length (length of the narrowed flow area) increases.

With regard to the condition (1), (3) and (4), the length of the passage 50 is restricted by the size of the disk plate 38. With regard to the condition (2), narrowing the flow passage will cause the pressure loss to increase and lowers the pump discharging ability. Therefore, it is preferred to maintain the minimum flow passage area in excess of 10 square millimeters, so that the pressure loss at the minimum flow passage area does not become too large.

In the above embodiment, each recess 51 is provided radially inside of the groove 50 and elongated closely to the bearing 32 by using a wall existing radially inside of the passage 50. Thus, it is possible to ensure the minimum flow passage area in excess of 10 square millimeters to reduce the pressure loss, and to ensure the maximum flow passage area by the elongation (length) of the recess 51. That is, it is possible to set the flow throttling ratio to ensure both the pressure pulsation reduction and the pressure loss reduction.

Figure 11:
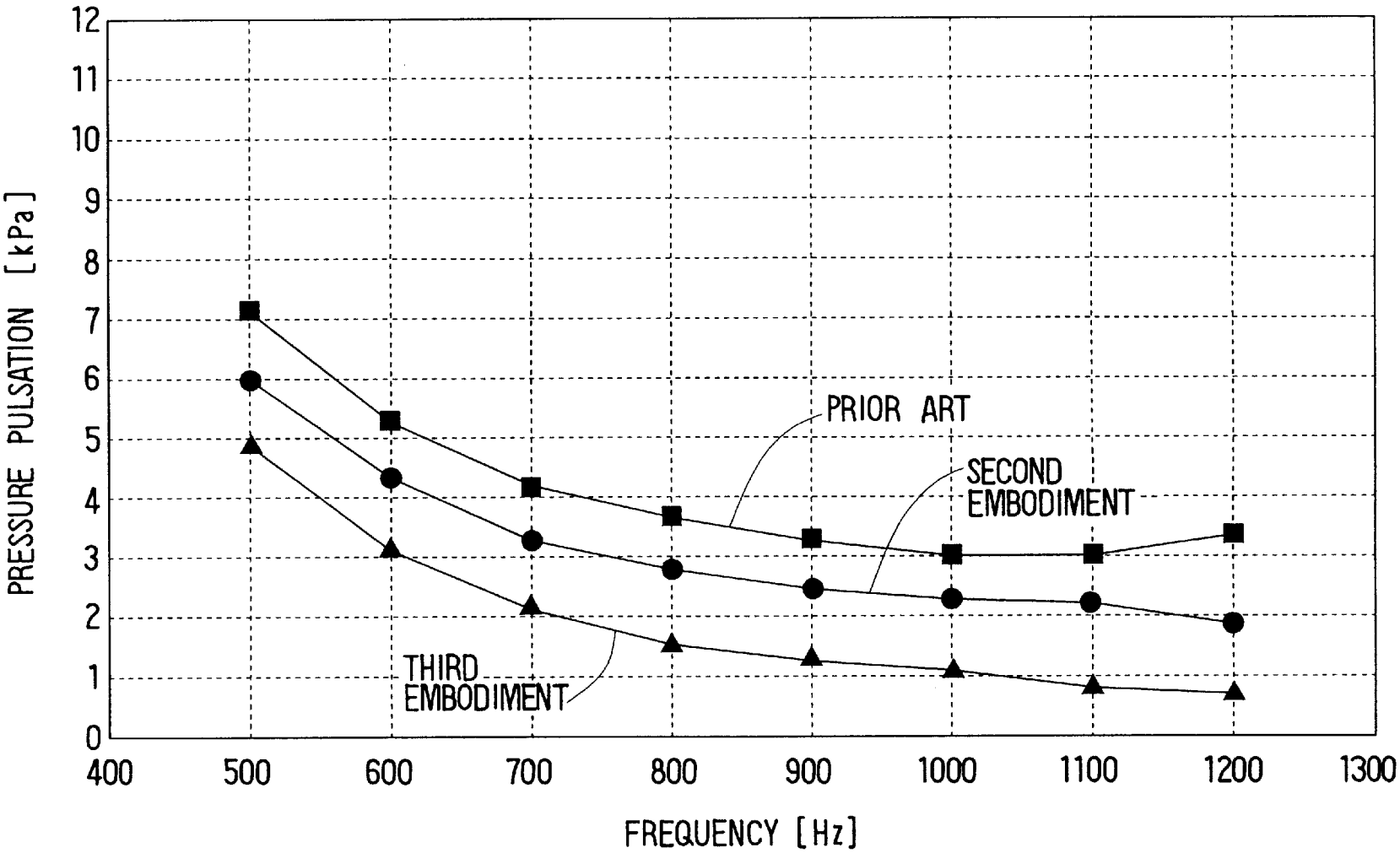
FIG. 11 is a graph showing results of experiment conducted with respect to pressure pulsation in the second and third embodiment.

The fuel pump according to the second embodiment was tested to measure the pressure pulsation occurring at a point immediately downstream of the fuel discharge outlet 18 (FIG. 1). In this testing, the number of inner gear teeth was set to 12, and the outer gear teeth was set to 13. As the pressure pulsation (gear primary pulsation) becomes the largest at a frequency, which is a multiplication of a motor rotational speed by the inner gear teeth number, the motor rotational speed was varied by varying a voltage applied to the motor unit 13. That is, the frequency of the gear primary pulsation was varied from 500 Hertz to 1200 Hertz. The pulsation was measured every 100 Hertz under the fixed discharge pressure, 300 kPa. It is to be understood from FIG. 11 showing the test result that the fuel pump according to the second embodiment has pressure pulsation less than that of the conventional pump over the entire range of frequency.

(Third Embodiment)

Figure 8:
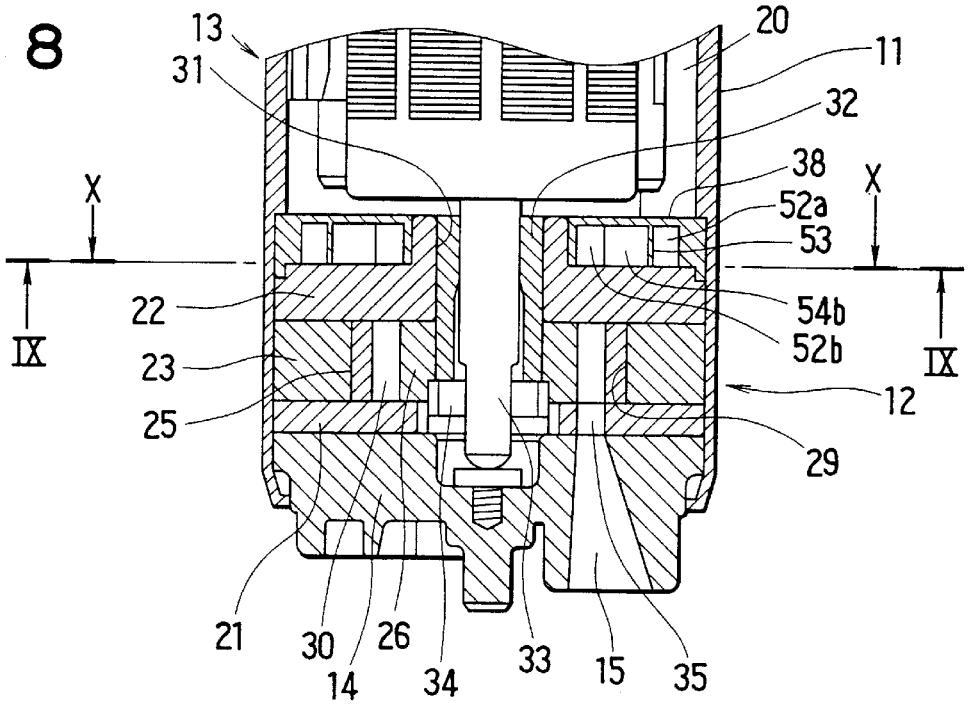
FIG. 8 is a partial front view showing a fuel pump, in section, according to a third embodiment of the present invention.
Figure 9:
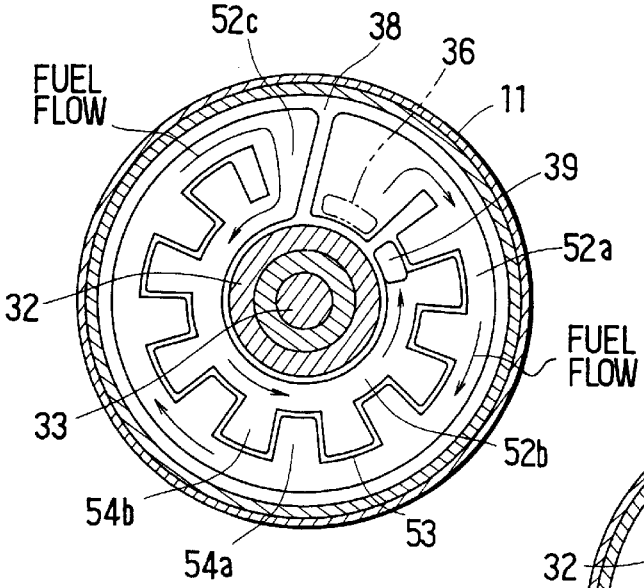
FIG. 9 is a sectional view showing the fuel pump taken along a line IX—IX in FIG. 8.
Figure 10:
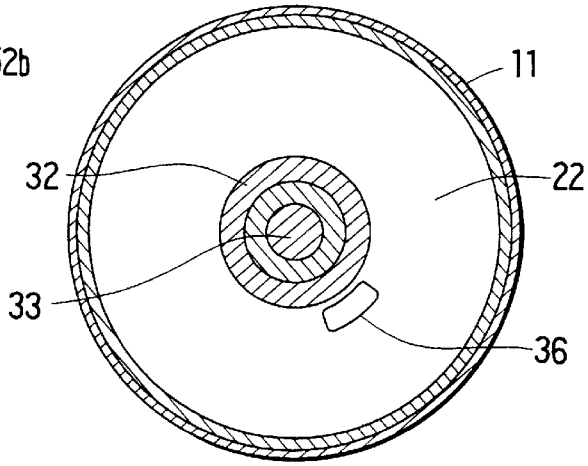
FIG. 10 is a sectional view showing the fuel pump taken along a line X—X in FIG. 8.

In the third embodiment shown in FIGS. 8 to 10, a pair of passages 52*a*, 52*b* is formed on the disk plate 38 along the outer circumference and the inner circumference of the disk plate 38. The passages 52*a*, 52*b* are separated by a partition wall 53, but are communicated at a turned portion 52*c* to provide a turned single passage, which has a sufficiently long passage length. The partition wall 53 is formed generally into a rectangular shape to provide a recess 54*a* and a recess 54*b* alternately in the circumferential direction. The recesses 54*a* are in communication with the passage 52*a*, and the recesses 54*b* are in communication with the passage 52*b*. The minimum flow area is set to be in excess of 10 square millimeters to reduce the pressure loss caused in the passages 52*a*, 52*b*.

In operation, when the pump unit 12 is driven by the motor unit 13, the fuel sucked into the passage 52*a* through the discharge port 36 flows through the passage 52*a*, turns at the turned portion 52*c*, flows through the passage 52*b* and discharges to the motor unit side from the discharge port 39.

According to this embodiment, as the passages 52*a*, 52*b* are turned to flow the fuel in opposite circumferential directions, the total length of the passage is lengthened more than in the first and second embodiments, thereby providing more pressure pulsation reduction.

The third embodiment was also tested with respect to its pressure pulsation reduction under the same condition as the second embodiment. As understood from FIG. 11, the pressure pulsation was reduced more than in the second embodiment.

The present invention should not be limited to the disclosed embodiments and modifications, but may be implemented in many other ways without departing from the spirit of the invention. For instance, the pressure pulsation reducing passage may be applied in other positive displacement type pump such as a roller type pump and a screw type pump. Further, it may be applied to a non-displacement type pump such as a turbine (Wetsco) type pump.

What is claimed is:

1. A fluid pump comprising:

a housing;

a pair of side plates provided on both sides of the housing to define a pump chamber;

a plate attached to one of the side plates to provide a fluid passage with the one of the side plates at a downstream of the pump chamber; and at least one of protrusions and recesses provided in the fluid passage to generate turbulence in fluid discharged from the pump chamber and flowing in the fluid passage, thereby reducing pressure pulsation in the fuel discharged from the fluid passage.

2. A fluid pump of claim 1, wherein:

the fluid passage is formed into an arcuate shape along a side surface of the one of the side plates.

3. A fluid pump of claim 1, wherein:

the fluid passage is turned to direct the fluid to flow in opposite directions.

4. A fluid pump of claim 1, wherein:

the pump chamber is formed into a positive displacement type.

5. A fluid pump of claim 1, further comprising:

a motor unit;

the plate is in a disk shape and disposed between the motor unit and the one of the side plates.

6. A fluid pump of claim 3, wherein:

the recesses provided at an upstream side and a downstream side of a turning of the passage are arranged alternately in a circumferential direction.

7. A fluid pump of claim 1, wherein:

the fluid passage is formed on a surface of the one of the side plates, which faces the plate.

8. A fluid pump of claim 7, wherein:

the fluid passage is formed along an outer circumference of the one of the side plates and has a width in a radial direction; and the recesses are arranged equi-angularly in a circumferential direction and extend in a radially inward direction from the fluid passage to a depth greater than the width of the fluid passage.

9. A fluid pump of claim 1, further comprising:

an outer rotor having a plurality of trochoid teeth on an inner circumference thereof and disposed in the pump chamber; and an inner rotor having a plurality of trochoid teeth on an outer circumference thereof and disposed in the pump chamber.

10. A fuel pump of claim 1, wherein:

both the one of the side plates and the plate have respective grooves, which jointly provide the fluid passage.

* * * * *